United States Patent [19]

Gipp et al.

[11] 4,035,145

[45] July 12, 1977

[54] QUATERNARY N-(2,3-EPOXYALKYL)-AMMONIUM COMPOUNDS

[75] Inventors: Roland Gipp, Cologne; Otto Berenstecher, Bensberg-Refrath; Horst Renziehausen, Monheim, all of Germany

[73] Assignee: Bayer Aktiengesellschaft, Leverkusen, Germany

[21] Appl. No.: 549,851

[22] Filed: Feb. 14, 1975

[30] Foreign Application Priority Data

Feb. 15, 1974 Germany ..... 2407147

[51] Int. Cl.[2] ..... D06P 5/02

[52] U.S. Cl. ..... 8/74; 8/51; 8/54.2; 8/172 R; 8/188; 8/189

[58] Field of Search ..... 8/74, 172, 188, 189

[56] References Cited

U.S. PATENT DOCUMENTS 3,853,460 12/1974 Balland ..... 8/84

FOREIGN PATENT DOCUMENTS 1,589,218 4/1970 France 472,630 9/1937 United Kingdom

*Primary Examiner*—Joseph L. Schofer

*Assistant Examiner*—A. L. Clingman

*Attorney, Agent, or Firm*—Plumley and Tyner

[57] ABSTRACT

Quaternary N-(2,3-epoxyalkyl)-ammonium compounds of the formula

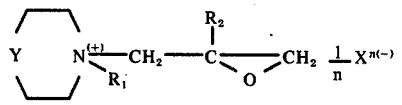

in which

Y represents a sulphur atom, a $CH_2$ group, a simple C-C bond or especially an oxygen atom, $R_1$ represents a $C_1$-$C_4$-alkyl group, a $C_2$-$C_4$-alkyl group substituted by an OH group or preferably the methyl group, $R_2$ represents hydrogen or methyl, $X^{n(-)}$ represents an anion and

*n* represents 1, 2 or 3 are used as fixing agents for substantive dyestuffs on cellulose fibre materials.

10 Claims, No Drawings

QUATERNARY N-(2,3-EPOXYALKYL)-AMMONIUM COMPOUNDS

The invention relates to the use of quaternary N-(2,3- epoxyalkyl)-ammonium compounds of the formula

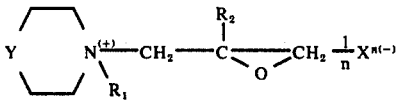

(I)

in which

Y represents a sulphur atom, a $CH_2$ group, a direct bond or especially an oxygen atom, $R_1$ represents a $C_1$-$C_4$-alkyl group, a $C_2$-$C_4$-alkyl group substituted by an OH group or preferably the methyl group, $R_2$ represents hydrogen or methyl, $X^{n(-)}$ represents an anion and

*n* represents 1, 2 or 3 as fixing agents for substantive dyestuffs on cellulose fibre materials.

The following may be mentioned as examples of $R_1$: the methyl, ethyl, n- and i-propyl and n- and sec.-butyl group as $C_1$-$C_4$-alkyl groups, and the 2-hydroxyethyl and above all the 2-hydroxypropyl group as a $C_2$-$C_4$-alkyl group substituted by an OH group.

Possible anions $X^{n(-)}$ are both anions of inorganic acids, for example the chloride, bromide, sulphate or phosphate ion, and of organic acids, for example of aromatic or lower aliphatic sulphonic acids, such as the benzenesulphonate, p-toluenesulphonate, methanesulphonate or ethanesulphonate ion as well as the anions of acid alkyl esters of inorganic acids, such as the methosulphate and the ethosulphate ion.

The following may be mentioned as examples of representatives of the compounds of the formula I: N-methyl-N-(2,3-epoxypropyl)-morpholinium chloride, N-ethyl-N-(2,3- epoxy-2-methyl-propyl)-thiamorpholinium chloride, N-butyl-N- (2,3-epoxypropyl)-piperidinium bromide, N-methyl-N-(2,3- epoxypropyl)-pyrrolidinium chloride, N-methyl-N-(2,3-l -epoxypropyl) -morpholinium p-toluenesulphonate, N-(2-hydroxyethyl)- N-(2,3-epoxypropyl)-morpholinium chloride, N-methyl-N-(2,3-epoxypropyl)-morpholinium methosulphate and N-ethyl-N-(2,3- epoxy-2-methyl-propyl)-morpholinium ethosulphate.

The compounds of the formula I can be prepared according to various processes which are in themselves known (see, for example, Houben-Weyl, Methoden der Organischen Chemie )Methods of Organic Chemistry), volume XI/2, page 611, 4th edition 1958; FR-PS 1,450,083, DOS (German Published Specification) 2,056,002 and US-PS 3,737,406).

The compounds of the formula I to be used according to the invention are preferably prepared by quaternisation of tertiary amines of the formula

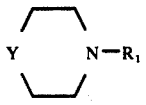

(II)

in which

Y and $R_1$ have the meaning indicated under the formula I, with epoxy compounds of the formula

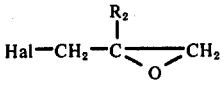

(III)

in which $R_2$ has the meaning indicated under the formula I and

Hal represents a halogen atom, preferably a chlorine or bromine atom.

The compounds of the formula I to be used according to the invention can be applied either by a pretreatment of the materials to be dyed, or simultaneously with the dyestuffs or by an after-treatment of the dyed cellulose materials.

The cellulose materials pretreated with the fixing agents of the formula I can subsequently be dyed from a dilute or concentrated liquor. The pretreatment, and also the after-treatment, are carried out by padding or printing the undyed or dyed cellulose fibre materials with aqueous liquors which contain the compounds according to the invention, of the formula I, preferably in an amount of 10 to 100 g, preferably 20 to 60 g, per liter of padding liquor or printing paste, together with the alkali required for fixing to the fibres, for example sodium carbonate, sodium bicarbonate or preferably sodium hydroxide solution, and subjecting the fibre materials, if appropriate after drying, to a heat treatment which consists of steaming for 5 to 10 minutes at 103° to 115° C or, preferably, of a brief treatment, lasting about 2 minutes, with dry heat (thermofixing) at 140° to 150° C. The fixing can also be carried out by the cold dwell process or warm dwell process, by keeping the padded or printed fibre material in the rolled-up state for 16 to 24 hours at room temperature or 4 to 8 hours at 70° to 90° C.

If the fixing agent and the dyestuff are applied simultaneously, this can be done by the pad-cold dwell, pad roll, pad-steam, thermofixing or thermosol process, or by the processes customary in textile printing. Advantageously, the fixing agents are employed in the padding liquors or printing pastes in amounts of 10 to 100 g, preferably 20 to 60 g, per liter of liquor or printing paste. When dyeing by the thermofixing process or thermosol process, it has proved advantageous to use, instead of the alkalis customarily employed in the liquors and printing pastes (sodium hydroxide, sodium carbonate and sodium bicarbonate), sodium trichloroacetate, in particularly preferably together with a buffering compound, such as monosodium dihydrogen phosphate (ratio of trichloroacetate: monosodium dihydrogen phosphate = 1 : 0.5 to 0.05).

The conjoint use of the fixing agents according to the invention, of the formula I, and of sodium trichloroacetate as the alkaline agent makes it possible to use a simplified process for dyeing mixtures of polyester fibres and cellulose fibres with substantive dyestuffs and disperse dyestuffs. As is known, epoxide-based fixing agents are applied from an alkaline padding liquor, that is to say a padding liquor containing sodium carbonate or sodium hydroxide solution. When used for dyeing with mixtures of substantive dyestuffs and dispersion dyestuffs, these alkalis lower the stability of the padding liquors containing the dispersion dyestuffs and in addition cause the substrate to turn brown under the thermosol treatment conditions. However, if the fixing agents according to the invention, of the formula I, are applied from liquors which contain sodium trichloroacetate as the alkaline agent and advantageously additionally contain monosodium dihydrogen phosphate, these disadvantages are avoided and it becomes possible to dye such fibre mixtures in a one-step process with direct dyestuffs and disperse dyestuffs. This process is distinguished by high economy and gives dyeings with excellent fastness properties.

The use of the fixing agents according to the invention, of the formula I, not only achieves a substantial deepening of the colour but also an excellent improvement of the fastness properties, especially of the wet fastness properties, of dyeings produced with substantive dyestuffs on cellulose materials.

The cellulose fibre materials are both materials of natural cellulose, such as cotton and linen, or of regenerated cellulose, such as viscose staple and rayon.

By substantive dyestuffs, there are understood the customary direct dyestuffs such as are summarised, for example, in the Colour Index, 3rd edition (1971), volume 2, on pages 2,005 to 2,478.

Compared to the known fixing agents for substantive dyestuffs on cellulose fibre materials, the fixing agents according to the invention offer the following advantages: because of the high stability of the fixing agents according to the invention, the alkaline padding liquors and printing pastes in which they are present have a substantially improved shelf life. Even in strongly alkaline padding liquors and printing pastes, that is to say those containing sodium hydroxide, the full effectiveness of the fixing agents remains preserved for at least 24 hours.

When using sodium bicarbonate, and above all sodium trichloroacetate as alkaline reagents, the activity even proves to be undiminished for several days. This is a considerable advance for use in dyeing, but especially for use in printing.

In neutral padding liquors or printing pastes the fixing agents according to the invention have such high stability that such liquors or printing pastes can be stored at room temperature for more than 1 week without a reduction in the activity of the fixing agents.

The fixing agents according to the invention, of the formula I, permit the use of shorter condensation times and lower condensation temperatures. When using the fixing agents according to the invention, a condensation time of merely 2 minutes at 140° C suffices to achieve optimum fastness properties of dyeings of standard depth shade.

The fixing agents of the formula I can be applied simultaneously with creaseproofing agents of the dimethylo- lethyleneurea-triazine resin type. This makes it possible to effect improvements in fastness, and creaseproof finishing, in one process step.

Because of their excellent fixing action it is possible to dispense with soaping the dyed cellulose materials at the boil, which in other cases is necessary to achieve good fastness properties. Very good fastness properties are achieved merely by simple hot rinsing.

The five-figure Colour Index numbers quoted in the examples which follow relate to the data in the Colour Index, 3rd edition (1971), volume 4; the other dyestuffs used are described in the Colour Index, 3rd edition (1971), volume 2.

EXAMPLE 1

A cotton fabric dyed with the direct dyestuff C.I. Direct Blue 244 to a 1/1-standard depth shade is padded at room temperature with an aqueous liquor which contains, per liter, 60 g of N-methyl-N-methyl-N-(2,3-epoxypropyl)-morpholinium chloride and 10 g of sodium hydroxide solution of 38° Be strength and is squeezed off to a weight increase of 80%. After drying at 100° C, the fabric is thermofixed for 2 minutes at 140° C and then washed for 10 minutes with water at room temperature.

A level blue dyeing, which is distinguished by very good fastness to washing at the boil, is obtained with very good colour yield (the fastness to washing at the boil determined according to DIN 54,011, gives a rating of 5, from an assessment of bleeding into fabric washed at the same time).

A good improvement in the wet fastness properties was also achieved by employing the same amount of N-methyl-N- (2,3-epoxypropyl)-thiamorpholinium chloride, N-methyl-N- (2,3-epoxypropyl)-piperidinium chloride or N-methyl-N-(2,3- epoxypropyl)-pyrrolidinium methosulphate instead of the fixing agent used above.

The N-methyl-N-(2,3-epoxypropyl)-morpholinium chloride used had been prepared as follows:

8,325 g (90 mols) of epichlorohydrin are heated to 50° C in a 10 l three-necked flask equipped with an internal thermometer, stirrer, dropping funnel, condenser and drying tube and thereafter 1,822 g (18 mols) of N-methylmorpholine were added continuously at the same temperature over the course of 1 hour, with intensive stirring and exclusion of atmospheric moisture. The reaction mixture is now stirred intensively for a further 24 hours under the same conditions and after approximately 1 hour from the end of the addition of the N-methylmorpholine the reaction product already begins to crystallise out. After cooling to room temperature and standing overnight, the reaction product is filtered off, repeatedly washed thoroughly with ethyl acetate and finally dried at 50° C, ultimately at 13 mm Hg, in a vacuum drying cabinet. Yield: 3,310 g of N-methyl- N-(2,3-epoxypropyl)-morpholinium chloride (95% of theory); grey-white hygroscopic salt; melting point: 160° to 161° C (decomposition); $C_8H_{16}ClNO_2$ (molecular weight 193.5); calculated: 18.33% Cl; found: 18.20% Cl.

EXAMPLE 2

Cotton poplin is padded at 60° C with a liquor which contains, per liter, 30 g of the direct dyestuff C.I. No. 35,860, 10 g of sodium hydroxide solution of 38° Be strength and 60 g of N-methyl-N-(2,3-epoxypropyl)-morpholinium chloride. The fabric is then dried, theremofixed for 2 minutes at 140° C, then rinsed, soaped for 5 minutes at the boil, again rinsed and dried.

A deep grey dyeing of good evenness and penetration is obtained. The dyeing displays the following wet fastness properties (determined according to DIN):

| | | |
|---|---|---|
| DIN 54,006 | Fastness to water, severe conditions | 5<br>5 |
| DIN 54,020 | Fastness to perspiration, alkaline conditions | 5<br>5 |
| DIN 54,020 | Fastness to perspiration, acid conditions | 5<br>5 |
| DIN 54,010 | Washing, 60° C | 5<br>5 |

-continued

| | | |
|---|---|---|
| DIN 54,011 | Washing, 95° C | 4<br>5 |

The upper figure relates to bleeding onto cotton and the lower figure to bleeding onto rayon or wool.

EXAMPLE 3

A rayon fabric is padded at 60° C with a liquor which contains, per liter, 20 g of the direct dyestuff C.I. Direct Green 68, 10 g of sodium hydroxide solution of 38° Be strength and 60 g of N-methyl-N-(2,3-epoxypropyl)-morpholinium chloride. The fabric is then steamed for 3 minutes at 103° C, rinsed, soaped at the boil, again rinsed and dried.

The resulting level green dyeing displays the following wet fastness properties (determined according to DIN):

| | | |
|---|---|---|
| DIN 54,006 | Fastness to water, severe conditions | 5<br>5 |
| DIN 54,020 | Fastness to perspiration, alkaline conditions | 5<br>5 |
| DIN 54,020 | Fastness to perspiration, acid conditions | 5<br>5 |
| DIN 54,010 | Washing, 60° C | 5<br>5 |
| DIN 54,011 | Washing, 95° C | 4<br>5 |

The upper figure relates to bleeding onto cotton and the lower figure to bleeding onto rayon or wool.

EXAMPLE 4

A cotton fabric is padded at room temperature with a liquor which contains, per liter, 20 g of the direct dyestuff C.I. No. 23,160, 40 g of N-methyl-N-(2,3-epoxypropyl)- morpholinium chloride and 6 g of sodium hydroxide solution of 38° Be strength and is squeezed off to a weight increase of 80%. The fabric is then rolled up and stored for 3 hours at a temperature of 85° C. It is then rinsed cold, soaped for 5 minutes at the boil, again rinsed and dried.

A level blue dyeing which is distinguished by outstanding wet fastness properties, especially good fastness to washing at the boil, is obtained with very good tinctorial yield.

EXAMPLE 5

A cotton fabric is padded at room temperature with a liquor which contains, per liter, 20 g of the direct dyestuff C.I. No. 27,970, 60 g of N-methyl-N-(2,3-epoxypropyl)- morpholinium chloride, 10 g of sodium hydroxide solution of 38° Be strength, 0.5 g of di-(2-ethyl-hexyl)-monosodium phosphate and 0.5 g of ethylene glycol. The fabric is squeezed off to a weight increase of 80%, rolled up, wrapped in a film and stored for 16 hours at room temperature. The fabric is then rinsed for 10 minutes with cold water and 10 minutes with hot water (70° C).

A level green dyeing with excellent wet fastness properties, in particular outstanding fastness to washing at the boil (rating 5 when determined according to DIN 54,011 and assessing the bleeding onto fabric washed at the same time) is obtained.

EXAMPLE 6

A rayon fabric is padded with a liquor which contains, per liter, 60 g of N-methyl-N-(2,3-epoxypropyl)-morpholinium chloride, 10 g of sodium hydroxide solution of 38° Be strength, 0.5 g of di-(2-ethyl-hexyl)-monosodium phosphate and 0.5 g of ethylene glycol and is dried at 100° C and thermofixed for 2 minutes at 140° C. The pretreated fabric is then dyed with the direct dyestuff C.I. Direct Black 112 in the usual manner, from a dilute liquor. The dyeing is finished in the usual manner and dried at a temperature of 80° to 90° C.

Compared to goods which have not been pretreated, a substantially deeper dyeing is obtained, which is distinguished by very good wet fastness properties, in particular outstanding fastness to washing at the boil.

EXAMPLE 7

A mercerised cotton fabric is printed with a paste which contains, per kg, 20 g of the direct dyestuff C.I. Direct Blue 225, 60 g of N-methyl-N-(2,3-epoxypropyl)- morpholinium chloride, 10 g of sodium hydroxide solution of 38° be strength, 100 g of urea and 500 g of neutral alginate thickener. The printed fabric is steamed for 10 minutes with saturated steam at 102° C. It is then rinsed cold and hot, soaped for 5 minutes at the boil and again rinsed and then dried.

A clear blue print is obtained, which is distinguished by outstanding wet fastness properties and of which the white background is not soiled by dyestuff which has bled out.

EXAMPLE 8

A rayon fabric is printed with a paste which contains, per kg, 20 g of the direct dyestuff C.I. Direct Blue 225, 60 g of N-methyl-N-(2,3-epoxypropyl)-morpholinium chloride, 20 g of sodium bicarbonate, 100 g of urea and 500 g of neutral alginate thickener. The printed fabric is dried and subjected to a heat treatment at 140° C for 2 minutes. It is then rinsed cold and warm, soaped for 20 minutes at the boil, again rinsed and dried.

A deep clear blue print is obtained, which is distinguished by outstanding wet fastness properties and of which the white background is not soiled by dyestuff which has bled out.

EXAMPLE 9

A mixed polyester/cotton (66:33) fabric is padded with a liquor at 50° C, which contains, per liter, 7 g of C.I. Direct Yellow 106, 30 g of C.I. Disperse Yellow 66, 100 g of urea, 60 g of N-methyl-N-(2,3-epoxypropyl)-morpholinium chloride, 20 g of the sodium salt of trichloroacetic acid and 1.5 g of neutral alginate thickener. After squeezing off to a weight increase of 80%, the fabric is dried at 100° C, thermosol-treated for 1 minute at 200° C, rinsed, soaped for 15 minutes at the boil, again rinsed and dried.

A deep yellow dyeing is obtained, which is distinguished by very good wet fastness properties (determined according to DIN):

| | | |
|---|---|---|
| DIN 54,006 | Fastness to water (severe conditions) | 5<br>5<br>5 |
| DIN 54,020 | Fastness to perspiration, alkaline conditions | 5<br>5<br>5 |
| DIN 54,020 | Fastness to perspiration, acid conditions | 5<br>5<br>5 |
| DIN 54,010 | Fastness to washing (60° C) | 5<br>5 |

-continued

| | | |
|---|---|---|
| DIN 54,011 | Fastness to washing (95° C) | 4–5<br>4<br>3–4<br>5 |

The figures relate to the following: the upper figure — change in colour shades; the middle figure — bleeding onto cotton or rayon; the lower figure — bleeding onto wool.

EXAMPLE 10

A cotton fabric which has been dyed in the usual manner with the direct dyestuff C.I. Direct Blue 225 in 1/1 standard depth shade, is padded at room temperature with a liquor which contains, per litre, 60 g of N-methyl-N-(2,3- epoxypropyl)-morpholinium chloride, 100 g of dimethylol- ethyleneurea-triazine resin and 10 g of sodium hydroxide solution of 38° Be strength. After squeezing off to a weight increase of 80%, the fabric is dried and condensed for 4 minutes at 140° C.

A level blue dyeing is obtained, which is distinguished by very good wet fastness properties, in particular by outstanding fastness to washing at the boil.

We claim:

1. In a process for dyeing cellulose fiber materials with substantive dyestuffs, the improvement comprising employing a quaternary N-(2,3-epoxyalkyl)-ammonium compound of the formula

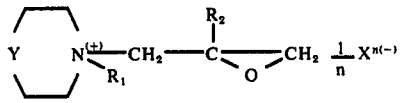

in which

Y is an oxygen atom or sulphur atom, a $—CH_2$13 group or a direct bond, $R_1$ is a $C_1$-$C_4$-alkyl group or a $C_2$-$C_4$-alkyl group unsubstituted or substituted by an OH group, $R_2$ is hydrogen or methyl, $X^{n(-)}$ is an anion, and

*n* is 1, 2 or 3 as a fixing agent for the dyestuffs.

2. The process of claim 1, wherein Y is oxygen.

3. The process of claim 2, wherein $R_1$ is methyl; and $R_2$ is hydrogen.

4. The process of claim 1, wherein the fiber materials are treated with the quaternary N-(2,3-epoxyalkyl)-ammonium compound in the presence of alkaline compounds before, during, or after dyeing.

5. The process of claim 4, wherein the fiber materials are treated by the thermofixing process or thermosol process during dyeing and sodium trichloroacetate is used as the alkaline compound.

6. The process of claim 4, wherein Y is oxygen.

7. The process of claim 16, wherein $R_1$ is methyl; and $R_2$ is hydrogen.

8. The process of claim 6, wherein $R_1$ is methyl; and $R_2$ is methyl.

9. The process of claim 4, wherein

Y is methylene or a direct bond;

$R_1$ is methyl; and $R_2$ is hydrogen.

10. The process of claim 4, wherein the quaternary N-(2,3-epoxyalkyl)-ammonium compound is N-methyl-N-(2,3-epoxypropyl)-morpholinium chloride.

* * * * *